US009566208B2

(12) United States Patent
Skendzel

(10) Patent No.: US 9,566,208 B2
(45) **Date of Patent: *Feb. 14, 2017**

(54) PNEUMATIC PRESSURE AND VACUUM DEVICE

(71) Applicant: Gary Skendzel, Berthoud, CO (US)

(72) Inventor: Gary Skendzel, Berthoud, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/011,076

(22) Filed: Jan. 29, 2016

(65) Prior Publication Data

US 2016/0235618 A1 Aug. 18, 2016

Related U.S. Application Data

(62) Division of application No. 13/678,373, filed on Nov. 15, 2012, now Pat. No. 9,248,073.

(51) Int. Cl.

| | |
|---|---|
| ***A61H 19/00*** | (2006.01) |
| ***A61H 9/00*** | (2006.01) |
| ***A61H 23/04*** | (2006.01) |

(52) U.S. Cl.

CPC ..... *A61H 9/0057* (2013.01); *A61H 9/005* (2013.01); *A61H 9/0007* (2013.01); *A61H 19/00* (2013.01); *A61H 19/30* (2013.01); *A61H 23/04* (2013.01); *A61H 2201/5005* (2013.01); *A61H 2201/5056* (2013.01); *Y10T 137/0396* (2015.04); *Y10T 137/86027* (2015.04); *Y10T 137/86405* (2015.04)

(58) Field of Classification Search

CPC ..... A61M 2230/005; A61M 2230/202; A61M 2230/205; A61M 35/00; A61M 11/00; A61H 19/32; A61H 23/02; A61H 19/50; A61H 19/30; A61H 19/40; A61H 23/00

See application file for complete search history.

(56) References Cited

U.S. PATENT DOCUMENTS

| | | | | |
|---|---|---|---|---|
| 9,248,073 | B2 * | 2/2016 | Skendzel | A61H 19/00 |
| 2003/0139255 | A1 * | 7/2003 | Lina | A61F 13/065 482/24 |

* cited by examiner

*Primary Examiner* — Christine H Matthews

(74) *Attorney, Agent, or Firm* — Christopher P. Whitham; William W. Cochran; Cochran Freund & Young LLC

(57) ABSTRACT

Disclosed is a pneumatic pressure and vacuum device that allows a user to adjust the duration of either pressure or vacuum that is applied to a pneumatic adult toy. A solenoid valve is used that is controlled by a solenoid for opening and closing ports that apply pressure and/or vacuum to a pneumatic adult toy. A timer is utilized to independently control the on and off times of the solenoid valve, so that vibrational frequency, as well as the amplitude of pressure and vacuum can be adjusted.

2 Claims, 3 Drawing Sheets

PNEUMATIC PRESSURE AND VACUUM DEVICE

CROSS-REFERENCED TO RELATED APPLICATION

The present application is a divisional application of patent application Ser. No. 13/678,373 for "Pneumatic Pressure and Vacuum Device" by Gary Skendzel, filed on. Nov. 15, 2012, which application is hereby incorporated by reference herein for all that it discloses and teaches.

BACKGROUND OF THE INVENTION

Pneumatic devices are used extensively in mechanical systems. Pneumatic systems typically use air as a medium to control various actions in mechanical systems. For example, pneumatic systems can operate valves, create forces in pneumatic cylinders and various other functions. Pneumatic systems typically use air compressors that create a wide range of pressure values for various purposes. Such systems are useful, simple and easy to implement.

SUMMARY OF THE INVENTION

An embodiment of the present invention may therefore comprise a method of operating a pneumatic adult toy comprising: generating a source of pressurized air using a compressor; applying the source of pressurized air to an input of solenoid valve; providing a pneumatic connection that connects the pneumatic adult toy to an output of the solenoid valve; providing a timer that can control the solenoid valve, so that a first period of time can be selected during which the source of pressurized air is applied to the pneumatic adult toy, and a second period of time can be selected during which pressurized air is not applied to the pneumatic adult toy.

An embodiment of the present invention may therefore further comprise a method of operating a pneumatic adult toy comprising: generating a source of low pressure air using a vacuum generator; applying the source of low pressure air to an input of a solenoid valve; providing a pneumatic connection that connects an adult toy to an output of the solenoid valve; providing a timer that can control the solenoid valve so that a first period of time can be selected during which the source of low pressure air is applied to the pneumatic adult toy, and a second period of time can be selected during which the source of low pressure air is applied to the pneumatic adult toy.

An embodiment of the present invention may therefore further comprise a pneumatic system for operating a pneumatic adult toy comprising: an air compressor that generates a source of pressurized air and a source of low pressure air; a solenoid valve having an output port and an input port that is connected to the source of pressurized air and the source of low pressure air; an adult toy that is connected to the output port of the solenoid valve; a timer that is connected to the solenoid valve that controls an adjustable first period of time during which the solenoid valve applies the source of pressurized air to the adult toy, and an adjustable second period of time during which the solenoid applies the source of low pressure air to the adult toy.

An embodiment of the present invention may therefore further comprise a pneumatic system for operating an adult toy comprising: an air compressor that generates a source of low pressure air; a solenoid valve having an output port and an input port that is connected to the source of low pressure air; an adult toy that is connected to the output port of the solenoid valve; a timer that is connected to the solenoid valve that controls an adjustable first period of time during which the solenoid valve applies the source of low pressure air to the adult toy, and an adjustable second period of time during which the solenoid valve does not apply the source of low pressure air to the adult toy.

DETAILED DESCRIPTION OF THE INVENTION

Figure 1:
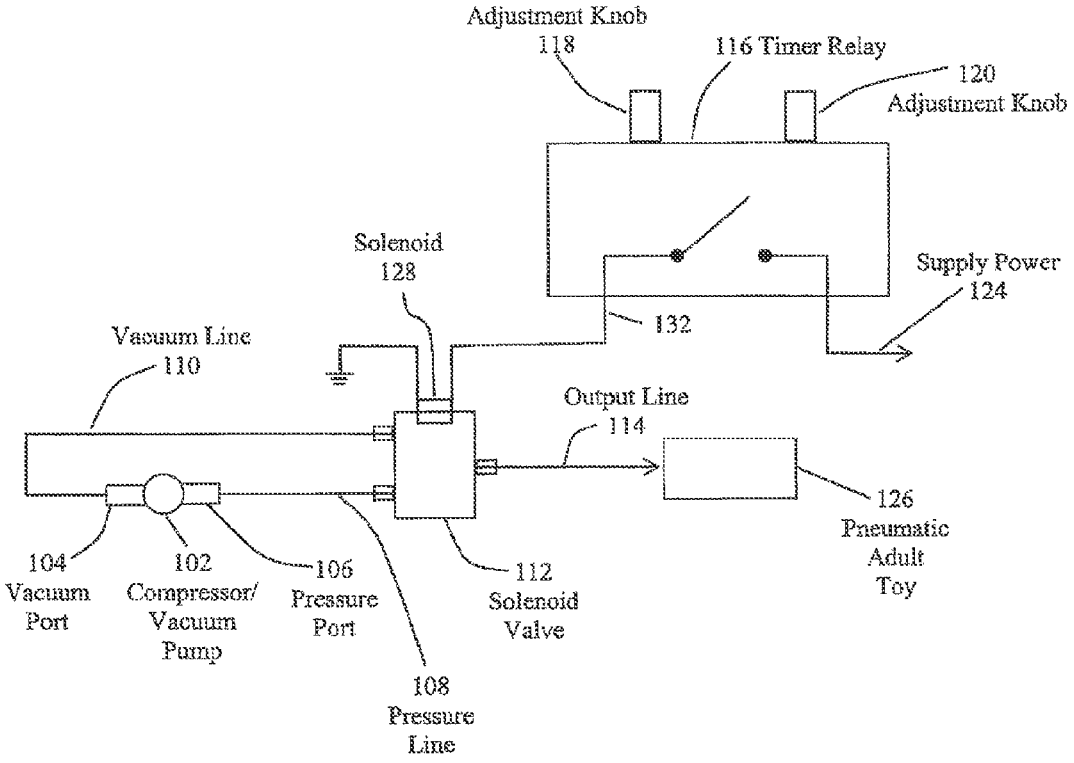
FIG. 1 is a schematic block diagram of an embodiment of a pneumatic system.

FIG. 1 is a schematic block diagram of a pneumatic system 100. As illustrated in FIG. 1, the pneumatic system 100 includes a compressor/vacuum pump 102. The compressor/vacuum pump 102 has a vacuum port 104 and a pressure port 106. Vacuum line 110 is connected to the vacuum port 104 of compressor/vacuum pump 102, while pressure line 108 is connected to the pressure port 106 of compressor/vacuum pump 102. The pressure line 108 and the vacuum line 110 are connected to a solenoid valve 112. The solenoid valve 112 is operated by a solenoid 128. Solenoid valve 112 may be connected to a pressure line 108, a vacuum line 110, or both a pressure line 108 and vacuum line 110. Solenoid 128 functions to open and close one or more valves in solenoid valve 112. For example, solenoid 128, upon application of a voltage from power supply 124, may open a port in the solenoid valve 112 that is connected to the pressure line 108 and the output line 114. Upon removal of the voltage from solenoid 128, the port connecting pressure line 108 and output line 114 is closed. Alternatively, another port may be opened upon application of a voltage to solenoid 128, which connects the vacuum line 110 to the output line 114. These functions are disclosed in more detail below.

Accordingly, the embodiment of FIG. 1 allows a user to have individual control of the expansion and contraction of the pneumatic adult toy 126, including the duration periods for the application of pressure, or the non-application of pressure, as well as the duration of the application of a vacuum, or the non-application of a vacuum, to the pneumatic adult toy 126. As such, the vibrational frequency, as well as the size of the pneumatic adult toy 126, can be controlled with a high degree of precision by using adjustment knobs 118, 120, which control two individual timers. This also allows the user to control the amount of vacuum desired. For pressure toys, control over the duration of application of pressure versus the non-application of pressure, or the duration of vacuum, controls the size of the pneumatic adult toy 126, which creates a repeating vibrational cycle. With respect to vacuum adult toys, the duration of the period of removal of air from the pneumatic adult toy 126 versus non-application of vacuum, or the application of pressure, controls the amount of vacuum created in the pneumatic adult toy 126.

The timer relay 116 may comprise, in one embodiment, two timers that vary from zero to 60 seconds. For example, adjustment knob 118 may vary the duration of the application of pressure from pressure line 108 to output line 114 for an adjustable period of from zero to 60 seconds, while adjustment knob 120 may vary the duration of the non-application of pressure, or the application of vacuum to the pneumatic adult toy 126 for an adjustable period of from zero to 60 seconds.

Figure 2:
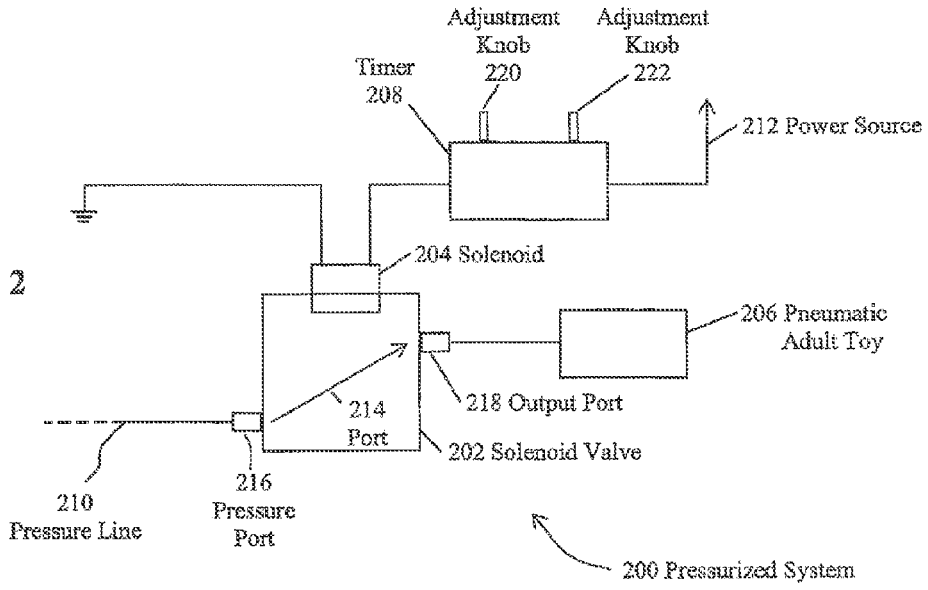
FIG. 2 is a schematic block diagram of an embodiment of a solenoid valve that is connected to a pneumatic device and a pressure line.

FIG. 2 is a schematic block diagram of an embodiment of a pressurized system 200. As illustrated in FIG. 2, solenoid valve 202 has a pressure port 216 that is connected to a pressure line 210 from a compressor (not shown). Solenoid 204 is actuated by a timer 208 that controls the application of power source 212 to the solenoid 204. Solenoid 204 opens and closes a valve that connects port 214 from the pressure port 216, to the output port 218. Knob 220 adjusts the duration of the period during which the port 214 is open, which connects pressure port 216 to output port 218. Adjustable knob 222 adjusts the duration of the period during which port 214 is closed. In this manner, the duration during which the pressure line 210 is connected to the pneumatic adult toy 206 is controlled by adjustment knob 220, while the duration period during which pressure line 210 is not connected to the pneumatic adult toy 206, is controlled by adjustment knob 220.

Figure 3:
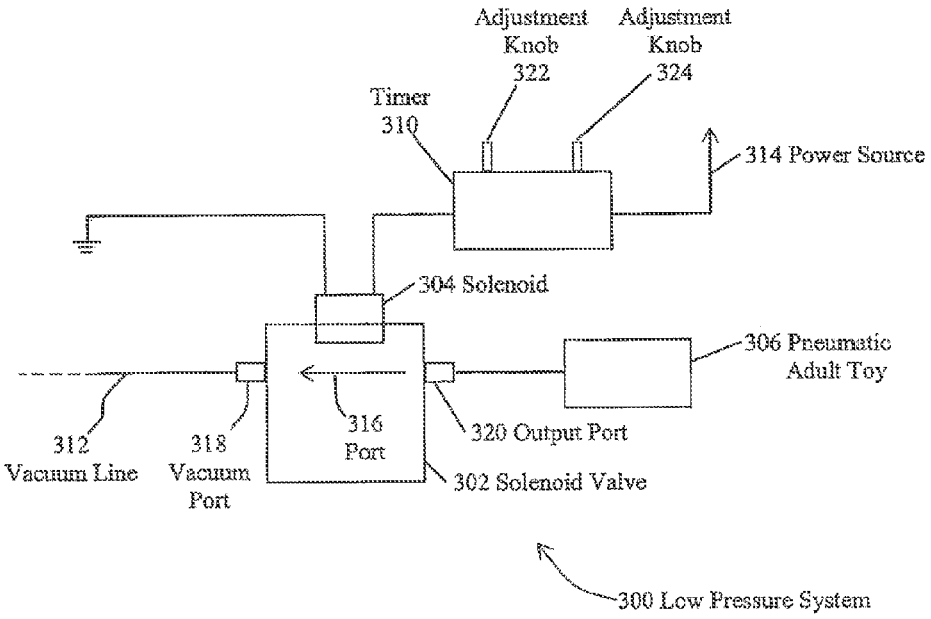
FIG. 3 is a schematic block diagram of another embodiment of a solenoid valve that is connected to a pneumatic device and a pressure and vacuum line.

FIG. 3 is a schematic block diagram illustrating a low pressure pneumatic system 300. As illustrated in FIG. 3, solenoid valve 302 is controlled by a solenoid 304. Solenoid 304 is, in turn, controlled by timer 310, that is connected to a power source 314. Timer 310 adjusts the time during which the power source 314 is connected to the solenoid 304. Adjustment knob 322 adjusts the amount of time that the power source 314 is connected to the solenoid 304. When the solenoid 304 is connected to the power source 314, port 316 is open, such that the output port 320 is connected to the vacuum port 318. In this manner, the vacuum line 312 is connected to the pneumatic adult toy 306 during that time period. When the power source 314 is not connected to the solenoid 304, port 316 is closed, so that there is no communication between the vacuum port 318 and the output port 320. Adjustment knobs 322, 324 therefore control the amount of time that the solenoid 304 is powered by the power source 314, which, in turn, controls the duration of time that the port 316 is open.

Figure 4:
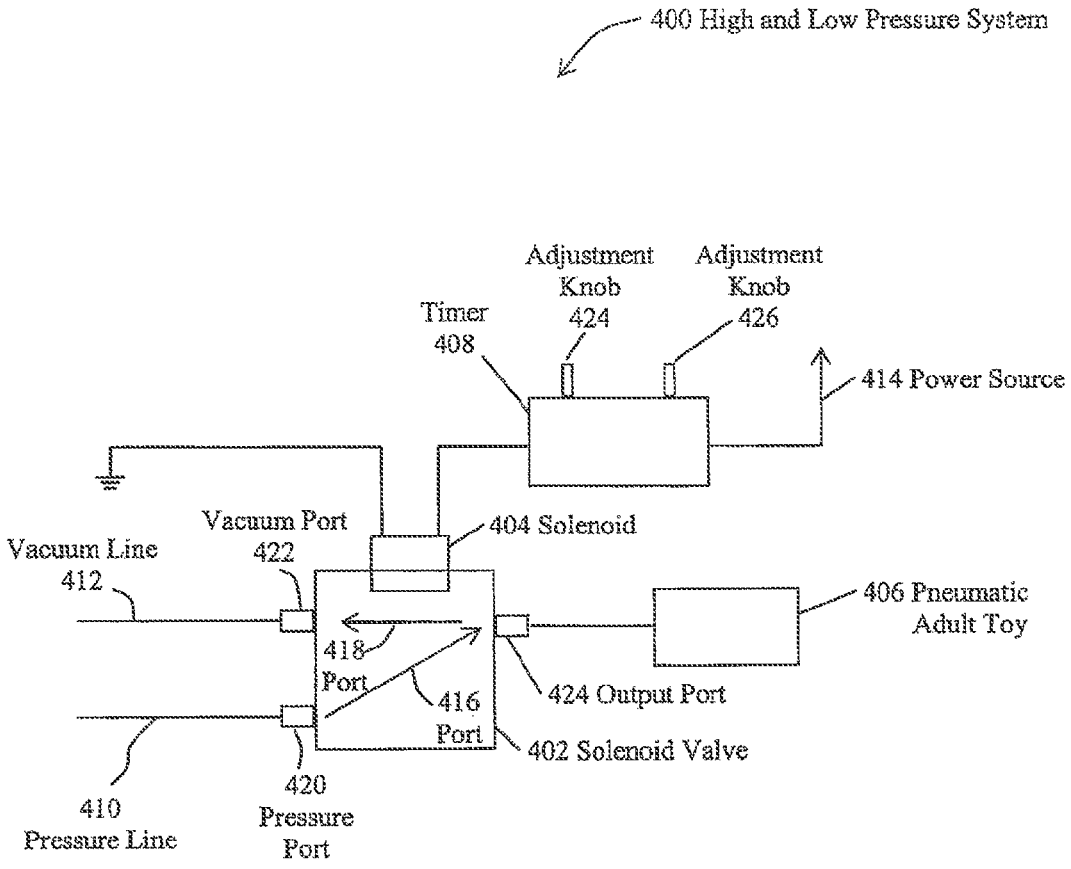
FIG. 4 is a schematic block diagram of another embodiment of a solenoid valve is connected to a pneumatic device, a pressure line, and a vacuum line.

FIG. 4 is a schematic block diagram of another embodiment of a high and low pressure system 400. As illustrated in FIG. 4, a solenoid valve 402 includes a port 416 that connects the pressure port 420 to the output port 424. Solenoid 402 also includes a port 418 that connects the output port 424 to vacuum 422. Pressure port 420 is connected to the pressure line 410 that is connected to a compressor/vacuum pump (not shown). Vacuum port 422 is connected to a vacuum line 412, which is also connected to the pressure/vacuum pump (not shown). Solenoid 404 operates the solenoid valve 402 in response to the application of power from power source 414. Timer 408 includes adjustment knobs 424, 426. Adjustment knob 424 controls the time during which power from power source 414 is applied to solenoid 404. Adjustment knob 426 controls the amount of time that the power source 414 is disconnected from the solenoid 404. Solenoid 404 may comprise multiple solenoids that operate valves that control ports 416, 418. In accordance with one embodiment, adjustment knob 424 may control the duration of time during which port 416 is open, so that pressure from pressure line 410 is applied to the output port 424 and pneumatic adult toy 406. Similarly, adjustment knob 426 may adjust the time during which port 418 is open and allows vacuum from vacuum 412 to be communicated to the output port 424 and the pneumatic adult toy 406. Timer 408 may be constructed so that the periods generated by the adjustment knobs 424, 426 do not overlap. In this manner, pressure can be applied to the pneumatic adult toy 406 during a first period and a vacuum can be applied to the pneumatic adult toy 406 during a second period. As such, both the size of the pneumatic adult toy, as well as the vibrational frequency of the pneumatic adult toy 406, can be controlled by a user, with adjustment knobs 424, 426.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of operating a pneumatic adult toy comprising:

generating a source of low pressure air;

providing a solenoid valve having a vacuum port, an output port, and a port connecting said vacuum port to said output port;

applying said source of low pressure air to said vacuum port of said solenoid valve;

connecting said pneumatic adult toy to said output of said solenoid valve;

providing a timer that can control said solenoid valve such that said timer can cause said solenoid valve to open or close said port connecting said vacuum port to said output port;

connecting said timer to said solenoid valve; and operating said timer such that said timer causes said solenoid valve to open said port connecting said vacuum port to said output port to apply said low pressure air to said pneumatic adult toy at a start of a first adjustable period of time and to close said port connecting said vacuum port to said output port at an end of said first adjustable period of time and such that said solenoid valve keeps said port connecting said vacuum port to said output port closed for a second adjustable period of time during which said low pressure air is not applied to said pneumatic adult toy.

2. A pneumatic system for operating an adult toy comprising:

a vacuum pump that generates a source of low pressure air;

a solenoid valve that has a vacuum port connected to said source of said low pressure air, an output port connected to an adult toy, and a port that connects said vacuum port to said output port;

a timer that is connected to said solenoid valve that controls said solenoid valve such that said timer causes said solenoid valve to open said port ting said vacuum port to said output port to apply said low pressure air to said adult toy at a start of a first adjustable period of time and to close said port connecting said vacuum port to said output port at an end of said first adjustable period of time and such that said solenoid valve keeps said port connecting said vacuum port to said output port closed for a second adjustable period of time during which said low pressure air is not applied to said adult toy.

* * * * *